US010369624B2

(12) United States Patent
Tang et al.

(10) Patent No.: US 10,369,624 B2
(45) Date of Patent: Aug. 6, 2019

(54) CONTROL METHOD AND APPARATUS FOR CONTINUOUS CASTING STEEL POURING

(71) Applicant: Baoshan Iron & Steel Co., Ltd., Shanghai (CN)

(72) Inventors: Anxiang Tang, Shanghai (CN); Lifeng Shentu, Shanghai (CN); Jikang Hu, Shanghai (CN); Dean Cao, Shanghai (CN); Xingyu Wang, Shanghai (CN); Chen Chen, Shanghai (CN); Jianqing Yao, Shanghai (CN); Xinghua Lu, Shanghai (CN); Jinsong Chen, Shanghai (CN); Aiping Feng, Shanghai (CN); Xiaoguang Yu, Shanghai (CN)

(73) Assignee: Baoshan Iron & Steel Co., LTD, Shanghai (CN)

( * ) Notice: Subject to any disclaimer, the term of this patent is extended or adjusted under 35 U.S.C. 154(b) by 35 days.

(21) Appl. No.: 14/408,873

(22) PCT Filed: Dec. 10, 2012

(86) PCT No.: PCT/CN2012/001660

§ 371 (c)(1),
(2) Date: Dec. 17, 2014

(87) PCT Pub. No.: WO2014/000135

PCT Pub. Date: Jan. 3, 2014

(65) Prior Publication Data

US 2015/0190863 A1 Jul. 9, 2015

(30) Foreign Application Priority Data

Jun. 29, 2012 (CN) ..... 2012 1 0219611

(51) Int. Cl.
*B22D 11/18* (2006.01)
*B22D 11/00* (2006.01)
(Continued)

(52) U.S. Cl.
CPC ..... *B22D 11/18* (2013.01); *B22D 11/001* (2013.01); *B22D 11/10* (2013.01); *B22D 11/181* (2013.01);
(Continued)

(58) Field of Classification Search
CPC ..... B22D 11/18; B22D 11/001; B22D 11/10; B22D 11/181; B22D 41/00; B22D 41/38; B22D 41/50; B22D 37/00
See application file for complete search history.

(56) References Cited

U.S. PATENT DOCUMENTS 4,210,192 A * 7/1980 Lavanchy ..... B22D 39/00 164/155.2
4,222,506 A * 9/1980 Sakashita ..... B22D 11/185 164/450.4
(Continued)

FOREIGN PATENT DOCUMENTS

JP 04167954 A * 6/1992
JP 06127492 A 5/1994
(Continued)

OTHER PUBLICATIONS

English Machine Translation of Mizuno JP-10-314911.*
(Continued)

*Primary Examiner* — Kevin P Kerns
*Assistant Examiner* — Steven S Ha
(74) *Attorney, Agent, or Firm* — Eversheds-Sutherland (US) LLP

(57) ABSTRACT

A control method and apparatus for continuous casting steel pouring are provided, wherein the amount of the molten steel flow of the ladle is controlled, thereby improving the yield of the molten steel and decreasing the production cost.

7 Claims, 3 Drawing Sheets

(51) Int. Cl.

| | |
|---|---|
| ***B22D 11/10*** | (2006.01) |
| ***B22D 37/00*** | (2006.01) |
| ***B22D 41/00*** | (2006.01) |
| ***B22D 41/50*** | (2006.01) |
| ***B22D 41/38*** | (2006.01) |

(52) U.S. Cl.
CPC ..... *B22D 37/00* (2013.01); *B22D 41/00* (2013.01); *B22D 41/38* (2013.01); *B22D 41/50* (2013.01)

(56) References Cited

U.S. PATENT DOCUMENTS

| | | | | | |
|---|---|---|---|---|---|
| 5,042,700 | A * | 8/1991 | Ardell | B22D 37/00 | 164/154.1 |
| 5,781,008 | A * | 7/1998 | Muller | B22D 2/003 | 324/226 |
| 2004/0079512 | A1* | 4/2004 | Hohenbichler | B22D 11/147 | 164/428 |
| 2004/0221981 | A1* | 11/2004 | Beale | B22D 5/02 | 164/323 |
| 2011/0062193 | A1* | 3/2011 | Sadano | B22D 11/18 | 222/590 |

FOREIGN PATENT DOCUMENTS

| | | | |
|---|---|---|---|
| JP | 0890216 | A | 4/1996 |
| JP | 09253815 | A | 9/1997 |
| JP | 1076355 | A | 3/1998 |
| JP | 10314911 | A * | 12/1998 |
| JP | 2002035910 | A | 2/2002 |
| JP | 2002327101 | A | 11/2002 |
| JP | 2003170257 | A | 6/2003 |

OTHER PUBLICATIONS

English Machine Translation of Muraoka JP-04-167954.*
PCT International Search Report for PCT Application No. PCT/CN2012/001660 dated Apr. 11, 2013 (5 pages).

* cited by examiner

CONTROL METHOD AND APPARATUS FOR CONTINUOUS CASTING STEEL POURING

CROSS REFERENCE TO RELATED APPLICATIONS

This application claims the priority benefit of PCT/CN2012/001660 filed on Dec. 10, 2012 and Chinese Application No. 201210219611.6 filed on Jun. 29, 2012. The contents of these applications are hereby incorporated by reference in their entirety.

TECHNICAL FIELD

The present invention relates to a control method and apparatus for continuous casting steel pouring during the tapping of continuously cast steel ladles.

BACKGROUND TECHNOLOGY

In the current pouring process of continuously cast steel ladles, the molten steel forms a vortex near the tapping hole of large steel ladles in the later stage of pouring, the steel slag floating on the surface of the molten steel converges at the center of the vortex and forms the shape of an inverted cone near the center of the vortex; under the adsorptive action of the vortex, the steel flag is drawn into the molten steel, and flows into the tundish through the long nozzle; if it is detected by the steel slag measurement means that steel slag amount has exceeded the specified standards, the apparatus for continuous casting steel pouring will activate the control system to close the sliding nozzle, so as to finish the pouring process. According to the principles of fluid mechanics, due to the existence of inverted cones of the steel slag, a large amount of molten steel is remained in the steel ladles. As indicated by the statistics of an enterprise about the steel slag amount of steel ladles after final pouring of continuously casting large steel ladles, the steel slag from a 150 ton steel ladle contains about 1~3 ton molten steel, and the steel slag from a 300 ton steel ladle contains about 1~5 ton molten steel. The residual molten steel is generally disposed of as steel slag, which causes resource wastage.

SUMMARY OF THE INVENTION

The object of present invention is providing a control method and apparatus for continuous casting steel pouring, by implementing optimization control over the molten steel discharging flow rate of steel ladles, so as to achieve the maximizing of discharging of molten steel while no or less steel slag flowing out and thus improve the yield rate of the molten steel.

In order to achieve above invention purpose, the present invention has used the following technical solution:

A control method for continuous casting steel pouring, including following steps:

Step one: measuring and reading the steel ladle pouring position signal by a steel ladle position sensor (14) mounted on a turntable of a steel ladle (1);

Step two: judging whether the pouring of the steel ladle (1) has begun therein by a steel pouring optimization control computer (13), back to the step one if the pouring of the steel ladle (1) has not begun, or forward to the step three if the pouring of the steel ladle (1) has begun;

Step three: reading and feeding a data of the steel slag measurement sensor (2) mounted above a steel ladle sliding nozzle (15) to an inferential controller within the steel pouring optimization control computer (13);

Step four: in the inferential controller, conducting a comparison between read data of the steel slag measurement and the manually set value of steel slag, and back to the step three if current measured value of the steel slag measurement is smaller than the manually set value of steel slag; if the current measured value of the steel slag measurement is greater than the manually set value of the steel slag, outputting and feeding a cylinder control variable to the PI controller in the steel pouring optimization control computer (13) and forward to the step five;

In the inferential controller, after the steel ladle and steel grade are selected, an opening degree d of the sliding nozzle is a function of a mass G of a molten steel inside a large steel ladle; a calculation formula of the opening degree d of the steel ladle sliding nozzle is:

$$d < 2320\ \mu D\sqrt{\frac{\pi}{\zeta G + \xi}}$$

Wherein: $\zeta = 4g\rho$;

$\xi = 2gl\rho^2\pi D^2$;

g: gravitational acceleration;

ρ: density of the molten steel inside the large steel ladle;

l: length of the long nozzle;

G: mass of the molten steel inside the large steel ladle;

D: effective diameter inside the steel ladle;

μ: viscosity of the molten steel;

Step five: conducting a comparison between the cylinder position signal output by the inferential controller and a cylinder position signal actually measured and a calculation in the PI controller, and feeding an output control signal to the cylinder driving unit (5) to drive the sliding nozzle driving cylinder (3) to move, thus reducing the opening degree of the sliding nozzle (15) of the steel ladle;

Step six: the PI controller sends the delayed signal, and reads the cylinder position signal with delaying for a period of time;

Step seven: when delayed time is passed, the PI controller reads current cylinder position signal;

Step eight: in the PI controller, judging the cylinder to be closed completely or not, and back to the step three to repeat above work if the cylinder has not been closed completely, or forward to the step nine if the cylinder has been closed completely;

Step nine, sending out the steel pouring termination signal, and back to the step one to repeat above work. A apparatus for continuous casting steel pouring, comprising: a steel ladle (1), a sliding nozzle (15), a steel ladle long nozzle (6), a tundish (7), a sliding nozzle driving cylinder (3) and a cylinder driving unit (5), wherein: said control device also includes a steel slag measurement sensor (2), a steel slag measurement signal amplifier (10), a steel ladle position sensor (14), a cylinder piston position sensor (4), an alarm (9) and a steel pouring optimization control computer (13); the steel pouring optimization control computer (13) includes an inferential controller and a PI controller; the steel slag measurement sensor (2) is installed above the sliding nozzle (15), and the steel slag measurement sensor (2) outputs signal to the steel slag measurement signal amplifier (10) and is connected with the steel pouring optimization control computer (13); the steel ladle position sensor (14) is installed on a turntable of the steel ladle (1), the steel ladle position sensor (14) outputs signal to an on-site process control computer (12); the on-site process control computer (12) outputs steel ladle position signal to a process signal interface unit (11); the process signal interface unit (11) outputs steel ladle position signal to the steel pouring optimization control computer (13); the cylinder piston position sensor (4) is installed on the sliding nozzle driving cylinder (3), the cylinder piston position sensor (4) outputs signal to the steel pouring optimization control computer (13); the output of the steel pouring optimization control computer (13) connects with the cylinder driving unit (5) and an alarm (9); the cylinder driving unit (5) outputs signal to the sliding nozzle driving cylinder (3) and drives the cylinder to move, so that controls the opening degree of the sliding nozzle (15). The control method and apparatus for continuous casting steel pouring of the present invention is to, measure the changing signal of the steel slag drawn into the molten steel in the pouring process by the steel slag measurement sensor installed on the sliding nozzle of the steel ladle, and then the steel pouring optimization control computer system is employed to make inferential analysis and judgment to provide the current new position of the sliding nozzle and control the closing process of the sliding nozzle. By controlling the sliding nozzle of the steel ladle, it is able to control the flow field distribution of the molten steel in the steel ladle, so as to avoid the turbulent flow of the molten steel in the steel ladle and thus achieve the object of controlling the remained molten steel inside the steel ladle.

By implementing optimization control over the molten steel discharging flow rate of steel ladles, the present invention can realize no or less steel slag flowing out while the maximizing of discharging of molten steel, and thus improve the yield rate of the molten steel and reduce the cost of production.

BRIEF DESCRIPTION OF DRAWINGS

In FIG. 1: 1 steel ladle; 2 steel slag measurement sensor; 3 sliding nozzle driving cylinder; 4 cylinder piston position sensor; 5 cylinder driving unit; 6 steel ladle long nozzle; 7 tundish; 8 mechanical arm; 9 on-site alarm and operation unit; 10 steel slag measurement signal amplifier; 11 process signal interface unit; 12 on-site process control computer; 13 steel pouring optimization control computer; 14 steel ladle position sensor; 15 sliding nozzle.

EMBODIMENTS

Drawings and embodiments are referred to further explain the present invention as follows.

Figure 1:
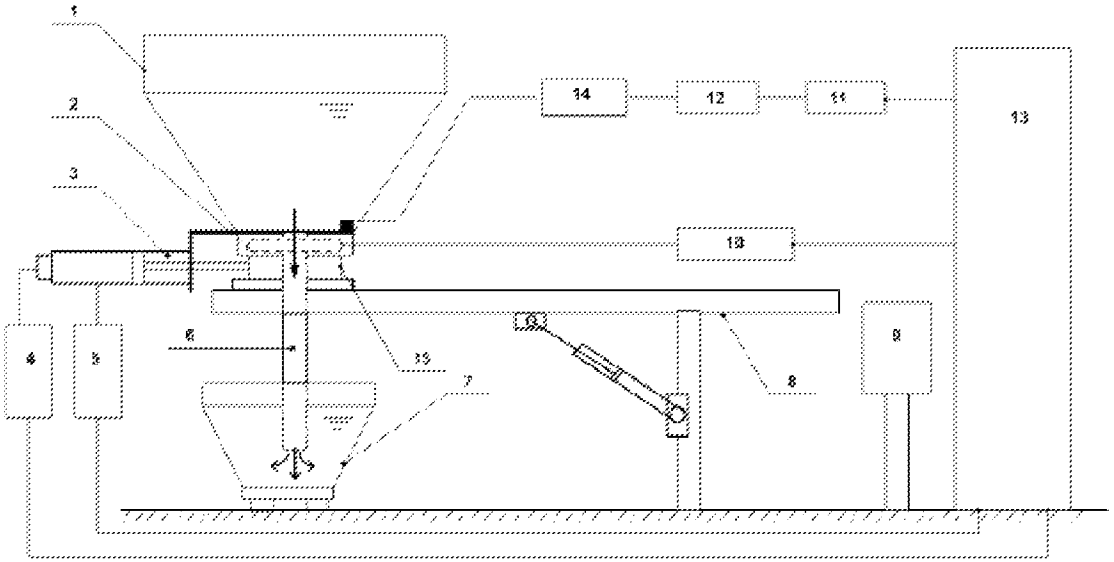
FIG. 1 is a schematic diagram of the control apparatus for continuous casting steel pouring of the present invention.

As shown in FIG. 1, a control method for continuous casting steel pouring of present invention is to conduct an online measurement of steel slag amount in the molten steel by a steel slag measurement sensor 2 installed above the sliding nozzle 15 of the steel ladle, and a steel slag measurement signal amplifier 10 amplifies the measured minor sensor signal and feeds it to an inferential controller, in which conducting a comparison between the actually measured steel slag amount value in the molten steel and a manually set steel slag amount value: If the actually measured steel slag amount value is less than the manually set steel slag amount value, the inferential controller will continue to read the output value of the steel slag measurement signal amplifier 10 and compare it with the manually set steel slag amount value; if the actually measured steel slag amount value is greater than the manually set steel slag amount value, the inferential controller will calculate a cylinder position signal and feed it to a PI controller, which will compare the cylinder control signal output from the inferential controller with the actual position feedback signal of the cylinder and then calculate and control cylinder action. The cylinder will drive a steel ladle sliding nozzle to move so as to change the flow rate of the molten steel, thus avoiding the turbulent flow of the molten steel produced in the steel ladle. The specifically analysis is as below:

According to Coriolis' theorem, fluid particles in the pipe, under the action of pressure difference, are influenced by axial force and radial force respectively, so that the fluid track in the pipe is in precession. In the fluid mechanics model, a large ladle long nozzle is a pipe with a minor diameter while the large ladle itself is provided with a pipe with a larger diameter, thus, as long as there is a pressure difference, the molten steel will flow in the manner of precession. In the process of flowing of the molten steel, the molten steel at the edges of the pipe will be in friction against the pipe wall, so that the molten steel at the edges of the pipe wall flows slower than that at the center of the pipe. Therefore, as the fluid in the pipe is concerned, the molten steel at the center flows faster while that the molten steel at the wall edges flows slower, and then the molten steel far from the center will flow toward the center, which is the reason that a vortex in the molten steel of the large steel ladle is produced.

As can be known from Reynolds' transport theorem of fluid mechanics, when the fluid level in a container lowered to a critical height, a vortex will form above the outlet. The molten steel presents the same phenomenon, and when the molten steel in the steel ladle approaches a critical height, a vortex will form above the tapping hole and draw the steel slag in it. The control method for continuous casting steel pouring of the present invention uses the principle of the formation of the vortex in the steel ladle to control the molten steel flow rate of the steel ladle through optimization control technology, so as to restrain the formation of vortex, so as to remain the steel slag inside the steel ladle and facilitate the discharging of the molten steel. The working principle of the control method for continuous casting steel pouring of the present invention is described below:

In the later stage of pouring of the large steel ladle, the molten steel forms a vortex therein, and when the molten steel inside the large steel ladle is discharged nearly finished, the rotational velocity of the molten steel is accelerated, and the steel slag is drawn into the molten steel and flows into a tundish. As the change of the rotational velocity of the molten steel causes the change of the Reynolds number of the molten steel flowing in the nozzle, turbulent flow will appear when it reaches the critical Reynolds number. Under certain conditions, the rule of self-excitated vibration incurred by the fluid flowing in the pipe does not change; when the steel slag appears, the rule of self-excitated vibration in the pipe will change. As can be known from Reynolds experiment, the motion state of the fluid is related to pipe diameter, fluid viscosity and fluid velocity. If pipe diameter d and fluid motion viscosity $\nu$ are constant, the velocity upon the change from laminar flow to turbulent flow will be called the upper critical velocity (represented by $\upsilon_c$); the average velocity upon the change from turbulent flow to laminar flow will be called lower critical velocity (represented by $\upsilon'_c$), and $\upsilon'_c > \upsilon_c$. If pipe diameter d or fluid motion viscosity ν changes, then, no matter how d, ν or $\upsilon_c$ changes, the corresponding dimensionless number $\upsilon_c d/\nu$ will be constant. The dimensionless number $\upsilon_c d/\nu$ is called Reynolds number $R_e$. Corresponding to upper and lower critical velocities, there will be:

Reynolds Number:

$$R_e = \frac{\rho u d}{\mu}$$

Wherein:

d—pipe diameter, m

ρ—fluid density, $kg \cdot m^{-3}$ u—fluid viscosity, Pa·s

μ—fluid velocity, $m \cdot s^{-1}$

Upper Critical Reynolds Number:

$$R_{ec} = \frac{\rho u_c d}{\mu}$$

Lower Critical Reynolds Number:

$$R_{e'c} = \frac{\rho u'_c d}{\mu}$$

It can be known through the determination of the flow in the circular pipe by Reynolds:

In the case that $R_{ec}<2320$, the flow state of the fluid in the circular pipe is laminar flow.

In the case that $R_{e'c}=13800\sim40000$, the flow state of the fluid in the circular pipe is turbulent flow.

The above description indicates that the lower critical Reynolds number of the flow in the circular pipe is a constant value, while the upper critical Reynolds number upon the change from laminar flow to turbulent flow is related to external disturbance, which always exists in actual flow. Thus, the upper critical Reynolds number is of no actual significance for determining the flow state, and generally the lower critical Reynolds number $R_{e'c}$ is regard as the standard for determining the flow state (laminar flow or turbulent flow), as provided below:

$R_e<R_{ec}=2320$, laminar flow in the pipe.

$R_e>R_{ec}=2320$, turbulent flow in the pipe.

Thus, the condition of the occurrence of turbulent flow in the long nozzle can be calculated according to continuous casting equipment data, that is:

$$R_e = \frac{\rho u d}{\mu} = 2320 \tag{1}$$

Wherein:

d—pipe diameter, m

ρ—fluid density, $kg \cdot m^{-3}$ u—fluid viscosity, Pa·s

μ—fluid velocity, $m \cdot s^{-1}$

According to Formula (1), the flow velocity of the molten steel flowing out of the steel ladle without causing turbulent flow can be deduced as below:

$$u < \frac{2320\ \mu}{\rho d} \tag{2}$$

When:

D: molten steel diameter in the large steel ladle;

s: area of the sliding nozzle;

H: molten steel height in the large steel ladle;

G: molten steel mass in the large steel ladle;

ρ: molten steel specific gravity in the large steel ladle;

p: molten steel static pressure in the large steel ladle;

l: length of long nozzle.

Then: molten steel area in the large steel ladle:

$$s = \tfrac{1}{2} D^2 \pi \tag{3}$$

molten steel mass in the large steel ladle:

$$G = \tfrac{1}{2} D^2 \pi H \rho \tag{4}$$

molten steel height in the large steel ladle:

$$H = \frac{2G}{D^2 \pi \rho} \tag{5}$$

velocity of molten steel in the large steel ladle upon reaching the outlet of the long nozzle:

$$v_t = \sqrt{2g(H+l)} = \sqrt{2g\left(\frac{2G}{\pi D^2 \rho} + l\right)} \tag{6}$$

To assure that there is no turbulent flow occurred in the flowing molten steel, the velocity $v_t$ of the molten steel shall satisfy Formula (2)

That is, $$v_t = u < \frac{2320\ \mu}{\rho d} \tag{7}$$

$$\sqrt{2g\left(\frac{2G}{\pi \rho D^2} + l\right)} < \frac{2320\ \mu}{\rho d}$$

Formula (7) may be rearranged as:

$$2g\left(\frac{2G}{\pi \rho D^2} + l\right) < \left(\frac{2320\ \mu}{\rho d}\right)^2 \tag{8}$$

$$\frac{2g(2G + \pi \rho D^2 l)}{\pi \rho D^2} < \frac{(2320\ \mu)^2}{\rho^2 d^2}$$

$$d^2 < \frac{(2320\ \mu)^2 \pi D^2}{\rho(4gG + 2g\pi\rho D^2 l)}$$

$$d < 2320\ \mu D \sqrt{\frac{\pi}{\rho(4gG + 2gl\rho\pi D^2)}}$$

Set: $\zeta = 4g\rho$ $\xi = 2gl\rho^2 \pi D^2$

Then: $d < 2320\ \mu D \sqrt{\frac{\pi}{\zeta G + \xi}}$

It can be known from the deduced Formula (8) that ζ=4gρ, wherein: ρ represents the density of the molten steel and is related to the steel grade, and ζ is a constant when there is a certain steel grade. $\xi=2gl\rho^2\pi D^2$, wherein ρ represents the density of the molten steel and is related to the steel grade, μ represents the viscosity of the molten steel and is also related to the steel grade, l represents the length of the nozzle and is a constant when the long nozzle is selected, and D represents the effective diameter of the molten steel in the steel ladle and is also a constant when the steel ladle is selected, so ζ is also a constant when the steel grade is selected. G represents the weight of the molten steel in the steel ladle, and is the value which varies most significantly in the formula: it reaches its maximum at the beginning of pouring of the steel ladle, and declines to its minimum at the end of pouring.

Formula (8) reveals the condition of the steel ladle being free of occurring turbulent flow in the pouring process, which is that: the opening degree d of the sliding nozzle of the steel ladle shall satisfy Formula (8). The formula (8) also reveals that when the steel ladle and steel grade are selected, the opening degree of the sliding nozzle of the steel ladle is only related to the weight of the molten steel in the steel ladle, that is, the opening degree of the sliding nozzle of the steel ladle is inversely proportional to the square root of the weight of the molten steel in the steel ladle.

The control method and apparatus for continuous casting steel pouring of the present invention is designed on the basis of this principle, and can realize the continuous online control of the opening degree of the sliding nozzle of the steel ladle on a real-time basis and thus control the molten steel to be free of occurring turbulent flow during flowing process, and assure that the molten steel in the ladle flows out completely.

Figure 2:
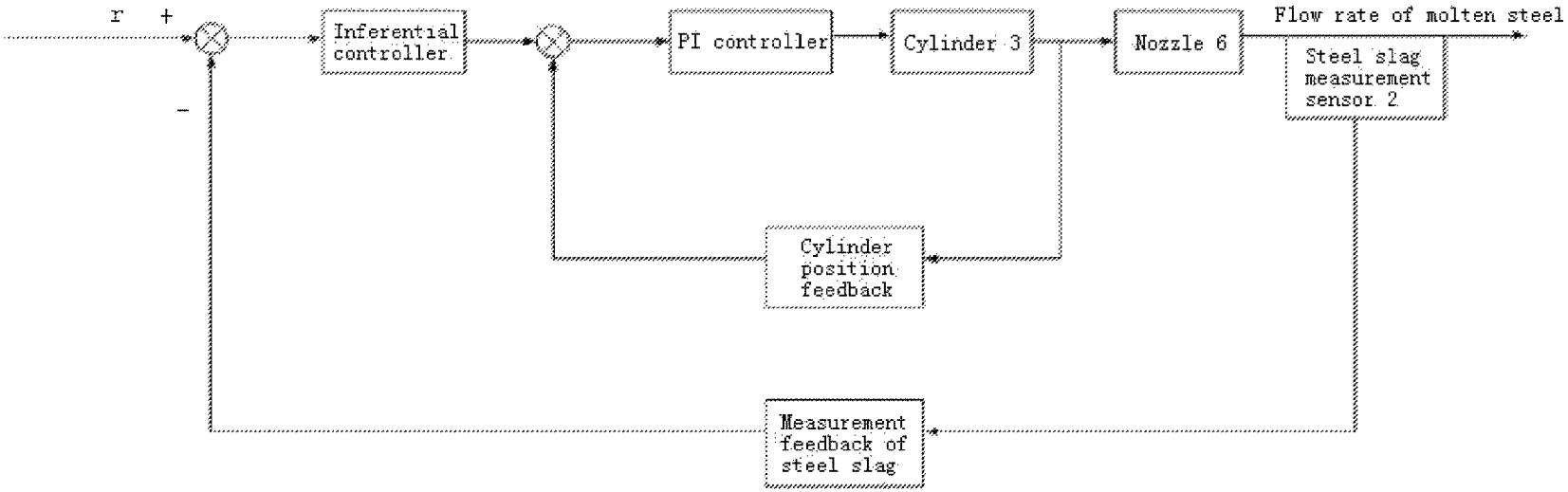
FIG. 2 is a schematic diagram of the control principle for continuous casting steel pouring of the present invention.
Figure 3:
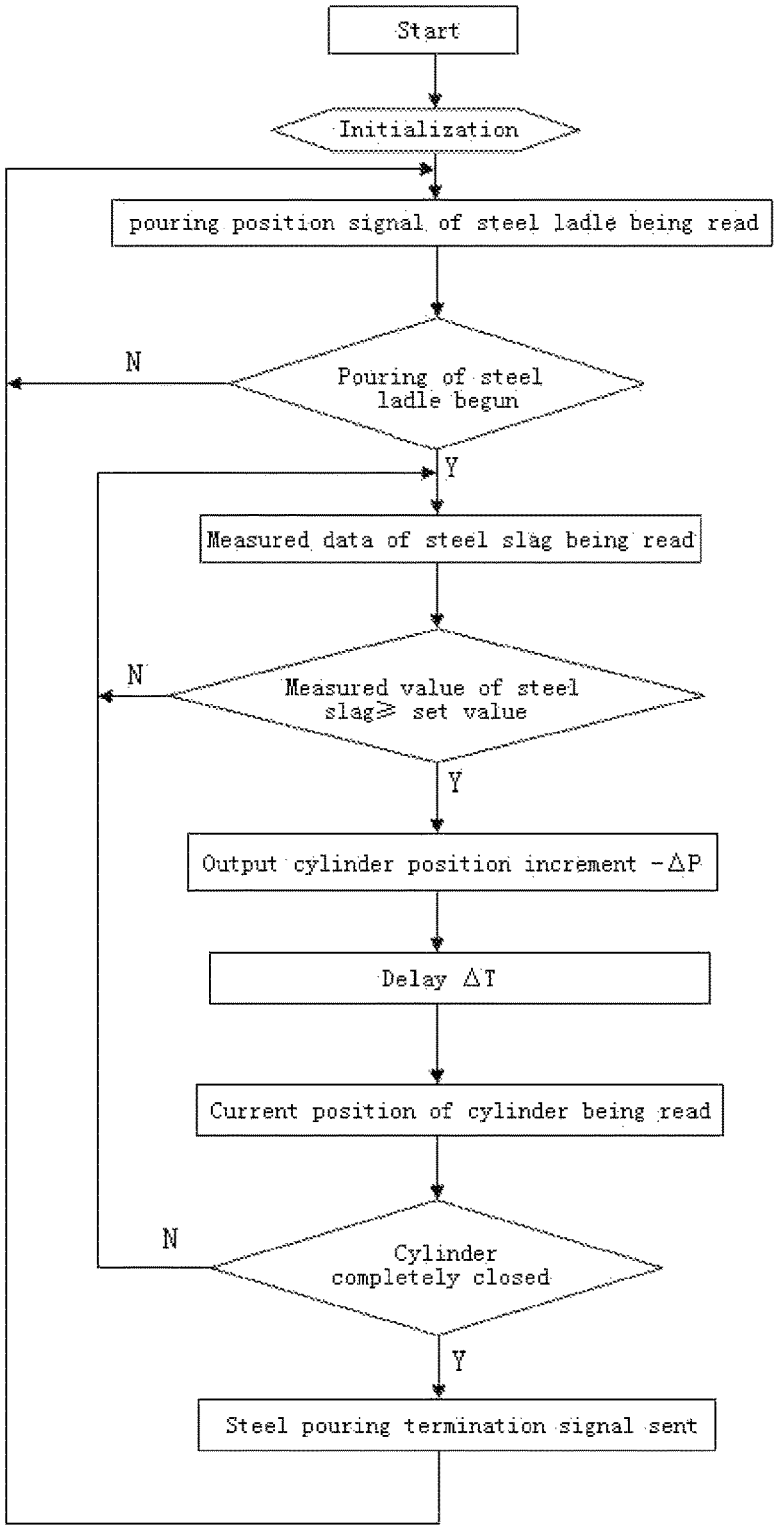
FIG. 3 is a flow chart of the control method for continuous casting steel pouring of the present invention.

FIGS. 1, 2 and 3 show a apparatus for continuous casting steel pouring of the present invention, which comprises a steel ladle 1, a sliding nozzle 15, a steel ladle long nozzle 6, a tundish 7, a sliding nozzle driving cylinder 3 and a cylinder driving unit 5, a steel slag measurement sensor 2, a steel slag measurement signal amplifier 10, a steel ladle position sensor 14, a cylinder piston position sensor 4, an alarm 9 and a steel pouring optimization control computer 13, wherein: the steel pouring optimization control computer 13 includes an inferential controller and a PI controller; the steel slag measurement sensor 2 is installed above the sliding nozzle 15, and the steel slag measurement sensor 2 outputs signal to the steel slag measurement signal amplifier 10; feeding the output signal of the steel slag measurement signal amplifier 10 to the steel pouring optimization control computer 13; the steel ladle position sensor 14 is installed on a turntable of the steel ladle 1, and outputs signal to an on-site process control computer 12 which then outputs steel ladle position signal to a process signal interface unit 11; the process signal interface unit 11 then outputs steel ladle position signal to the steel pouring optimization control computer 13; the cylinder piston position sensor 4 is installed on the sliding nozzle driving cylinder 3, and outputs signal to the steel pouring optimization control computer 13, which then feeds the signal to the cylinder driving unit 5 and an alarm 9; the cylinder driving unit 5 outputs signal to the sliding nozzle driving cylinder 3 and drives the cylinder to move, so that controls the opening degree of the sliding nozzle 15.

The control method for continuous casting steel pouring of the present invention is realized on the basis of the above control apparatus for continuous casting steel pouring, and includes the following steps (see FIG. 3):

Step one (see FIG. 1), the steel pouring optimization control computer 13 reads the signal of the steel ladle position sensor 14 installed on the turntable of the steel ladle 1 via the process signal interface unit 11 and the on-site process control computer 12, so as to obtain the information of the pouring position of the steel ladle;

Step two, the steel pouring optimization control computer 13 judges whether the pouring of the steel ladle 1 has begun on the basis of the information of the pouring position of the steel ladle, and back to the step one if the pouring of the steel ladle has not begun, or forward to step three if the pouring of the steel ladle has begun;

Step three, feeding the output signal of the steel slag measurement sensor 2 to the steel slag measurement signal amplifier 10, and the steel slag measurement sensor 2 is installed above the sliding nozzle 15 of the steel ladle; the steel pouring optimization control computer 13 reads the output signal of the steel slag measurement signal amplifier 10 to obtain the steel slag amount of the current molten steel, and feed it to the inferential controller in the steel pouring optimization control computer 13.

Step four (see FIG. 2), conducting a comparison between the measured data of steel slag amount in the molten steel and the manually set value r of steel slag amount in the molten steel in the inferential controller, and back to the step three if current measured value of the steel slag measurement is smaller than the manually set value of steel slag; if the current measured value of the steel slag measurement is greater than the manually set value of the steel slag, feeding an output cylinder control variable to the PI controller in the steel pouring optimization control computer 13 and forward to the step five;

In the inferential controller, after the steel ladle and the steel grade are selected, the opening degree d of the sliding nozzle is a function of the mass G of the molten steel inside the large steel ladle. The calculation formula of the opening degree d of the steel ladle sliding nozzle as below:

$$d < 2320\ \mu D\sqrt{\frac{\pi}{\zeta G+\xi}}$$

Wherein: $\zeta = 4g\rho$;

$\xi = 2gl\rho^2\pi D^2$;

g: gravitational acceleration;

ρ: density of the molten steel inside the large steel ladle;

l: length of the long nozzle;

G: mass of the molten steel inside the large steel ladle;

D: effective diameter inside the steel ladle;

μ: viscosity of the molten steel.

Step five, conducting a comparison between the cylinder position signal output by the inferential controller and the actually measured cylinder position signal and a calculation in the PI controller, and feeding the output control signal to the cylinder driving unit 5 to drive the sliding nozzle driving cylinder 3 to move, thus reducing the opening degree of the sliding nozzle 15 of the steel ladle.

Step six, the PI controller sends the delayed signal, and reads the position feedback signal of the cylinder 3 with delaying for a period of time;

Step seven, when the delayed time is passed, the PI controller reads the current position signal of the cylinder 3;

Step eight, in the PI controller, judging the cylinder 3 to be closed completely or not, and back to the step three to repeat above work if the cylinder has not been closed completely, or forward to the step nine if the cylinder has been closed completely;

Step nine, sending out the steel pouring termination signal, and back to the step one to repeat the above work.

Provided above are only preferred embodiments of the present invention, which are in no way used to limit the scope of protection of the present invention. Thus, any modification, equivalent substitution, improvement or other changes made in the spirit and principle of the present invention shall fall within the scope of protection of the present invention.

The invention claimed is:

1. A control apparatus for continuous casting steel pouring, comprising: a steel ladle, a sliding nozzle, a steel ladle long nozzle, a tundish, a sliding nozzle driving cylinder, a cylinder driving unit, an inferential controller comprising a unit for receiving data, analyzing the received data, computing at least one value based on the analyzed data, and output a control function, and a PI controller, wherein the steel ladle long nozzle connects the steel ladle and the tundish;

wherein further, the inferential controller is configured to:

obtain a steel slag amount signal from a steel slag measurement sensor;

determine that the steel slag amount signal is greater than a manually set steel slag amount value;

in response to the steel slag amount signal being greater, determine a cylinder control signal; and send the cylinder control signal to the PI controller;

wherein the PI controller is configured to determine a degree of opening of the sliding nozzle based on the cylinder control signal and outputs a second signal to the cylinder driving unit based on the determined degree of opening of the sliding nozzle; and wherein, upon receipt of the second signal, the cylinder driving unit is configured to adjust the degree of opening of the sliding nozzle based on the second signal by sending one or more third signals to the sliding nozzle driving cylinder.

2. The control apparatus of claim 1, further comprising a steel slag measurement sensor, a steel slag measurement signal amplifier, a steel ladle position sensor, a cylinder piston position sensor, an alarm, and a steel pouring optimization control computer.

3. The control apparatus of claim 2, wherein the steel ladle position sensor is installed on a turntable of the steel ladle, and wherein the steel ladle position sensor outputs a signal to an on-site process control computer.

4. The control apparatus of claim 3, wherein the on-site process control computer outputs a steel ladle position signal to a process signal interface unit.

5. The control apparatus of claim 4, wherein the process signal interface unit outputs the steel ladle position signal to the steel pouring optimization control computer.

6. The control apparatus of claim 2, wherein the cylinder piston position sensor is installed on the sliding nozzle driving cylinder, and wherein the cylinder piston position sensor outputs a signal to the steel pouring optimization control computer.

7. The control apparatus of claim 6, wherein computer connects with the cylinder driving unit and an alarm" with—an output of the steel pouring optimization control computer connects with the cylinder driving unit and the alarm.

* * * * *